United States Patent [19]

Sasaki et al.

[11] 4,136,734

[45] Jan. 30, 1979

[54] FEEDWATER HEATER

[75] Inventors: Takuya Sasaki; Tamotsu Yamane; Yoshun Horibe; Mituo Suzuki, all of Hitachi, Japan

[73] Assignee: Hitachi, Ltd., Tokyo, Japan

[21] Appl. No.: 694,156

[22] Filed: Jun. 8, 1976

[30] Foreign Application Priority Data

Jul. 5, 1975 [JP] Japan ..... 50-82974

[51] Int. Cl.[2] ..... F28B 1/02; F28F 9/26; F28D 7/06

[52] U.S. Cl. ..... 165/111; 122/32; 122/483; 165/143; 165/163; 165/176

[58] Field of Search ..... 165/143, 158, 163, 176, 165/161, 111; 122/32, 483; 29/157.4

[56] References Cited

U.S. PATENT DOCUMENTS

| | | | |
|---|---|---|---|
| 1,798,354 | 3/1931 | Ris | 165/143 |
| 2,391,244 | 12/1945 | Jackson | 165/143 |
| 2,612,350 | 9/1952 | Stadler | 165/143 |
| 2,845,906 | 8/1958 | Gram, Jr. | 122/32 |
| 2,996,600 | 8/1961 | Gardner, Jr. et al. | 29/157.4 |
| 3,020,024 | 2/1962 | Lawrence | 165/139 |
| 3,074,480 | 1/1963 | Brown, Jr. et al. | 165/143 |
| 3,118,497 | 1/1964 | Olson | 165/157 |
| 3,168,136 | 2/1965 | Ammon | 165/157 |
| 3,249,153 | 5/1966 | Holland | 165/143 |
| 3,258,068 | 6/1966 | Hollister | 29/157.4 |
| 3,447,509 | 6/1969 | Sprague | 122/32 |
| 3,452,721 | 7/1969 | Mariette et al. | 122/32 |
| 3,490,521 | 1/1970 | Byerley | 165/158 |
| 3,906,904 | 9/1975 | Kraupa | 122/32 |
| 3,923,008 | 12/1975 | Beckmann et al. | 122/34 |
| 3,942,481 | 3/1976 | Bennett | 122/32 |
| 3,948,315 | 4/1976 | Powell | 165/143 |
| 4,010,797 | 3/1977 | Parnkopk et al. | 122/32 |

*Primary Examiner*—Charles J. Myhre
*Assistant Examiner*—Sheldon Richter
*Attorney, Agent, or Firm*—Thomas E. Beall, Jr.

[57] ABSTRACT

The feedwater heater of this invention comprises a plurality of heating tubes arranged in U form, with feedwater being passed therethrough, a feedwater inlet chamber having a feedwater inlet for introducing feedwater thereinto and a tube plate assembling the ends of said heating tubes and also having formed therein a feedwater reservoir, a feedwater outlet chamber having a feedwater outlet for discharging the heated feedwater and a tube plate assembling the other ends of said heating tubes and also having formed therein a feedwater reservoir, a first cylindrical body or shell having disposed therein a tube nest consisting of the U-formed heating tube portions positioned on one side as well as support plates holding said heating tubes in position, said cylindrical body having its one end communicated with said feedwater outlet chamber and also provided with a hot steam inlet for introducing hot steam that serves as the feedwater heating source, a second cylindrical body or shell having disposed therein a tube nest consisting of the U-formed heating tube portions positioned on the other side as well as support plates holding said heating tubes in position, said second cylindrical body having its one end communicated with said feedwater inlet chamber and provided with a condensate outlet for discharging the steam condensate out of the system, and a spherical container formed from two hemispherical shells communicated with said both cylindrical bodies and having therein a space housing the bent portions of said U-formed heating tubes.

6 Claims, 4 Drawing Figures

FEEDWATER HEATER

BACKGROUND OF THE INVENTION

This invention relates to a multitubular heat exchanger, and more particularly to a feedwater heater for preheating feedwater supplied to a turbine plant where steam is used as driving power source.

There is an increasing tendency toward enlargement of the feedwater heater system to keep line with ever-expanding power plant capacity, but a request is now voiced in the industry for innovation of the structural system in view of the limitations in production techniques, construction, function and so forth.

Among the single-body type feedwater heaters of the prior art is the device disclosed in U.S. Pat. No. 3,020,024 (patent granted Feb. 6, 1962). In this feedwater heater, both ends of the heating tubes bent in U shape and arranged in the inside of the heater body are disposed in a hemispherical water chamber formed integral with the tube plate. In the inside of said water chamber is provided a partition plate which defines a feedwater inlet and a feedwater outlet. Provided in this feedwater heater are a desuper heating zone, a condensing zone and drain subcooling zone, and the feedwater supplied into the heater from the inlet is heated while flowing through the heating tubes by hot steam also flowing in the heater body, and is discharged out from the outlet as highly heated water. On the other hand, hot steam supplied from a steam inlet enters first into the desuper heating zone, then flows into the condensing zone for condensation therein, and then further advances into the drain subcooling zone where steam condensate is cooled and then discharged out from the condensate outlet. The desuper heating zone is defined by an inner cylinder disposed so as to cover the corresponding heating tube portions, while the drain subcooling zone is also defined by an inner cylinder which is also so disposed as to sheathe the corresponding heating tube portions.

The feedwater heaters of such conventional system incorporating all the component elements in one body have a drawback that the entire heater unit is enlarged in size as the heat transfer area in the heater is increased with expansion of the plant capacity and also the thickness of the shell as well as the tube plates of the water chambers must be increased to withstand the elevated steam pressure. They also involve the problem that great difficulties attend in machining holes for inserting the heating tube ends owing to increased thickness of the tube plate.

Among the proposed heat exchangers with enlarged structure is known a hairpin type heat exchanger such as disclosed in U.S. Pat. No. 3,249,153. Adaptation of this heat exchanger as a feedwater heater for a turbine plant, however, is attended by difficulties in installation because it is required for providing sufficient strength to enlarge the size while increasing thickness of both the inner cylinder defining the desuper heating zone and the inner cylinder defining the drain subcooling zone. Further, as the joints of the two hairpin-forming body portions are of a flange type, difficulty is encountered in sealing the high-pressure fluid flowing in the system, and also the body structure is enlarged because of necessarily increased flange thickness.

SUMMARY OF THE INVENTION

An object of this invention is to provide a hairpin type feedwater heater with a large capacity but reduced in overall structural dimensions.

Another object of this invention is to provide a hairpin type feedwater heater which is reduced in overall structure and provided with means for facilitating maintenance and inspection of the heating tubes.

Still another object of this invention is to provide a hairpin type feedwater heater which is reduced in overall structural size and also simplified in the operating mechanism.

In order to accomplish these objects, there is provided according to this invention a feedwater heater with a reduced structural size, comprising essentially a feedwater inlet chamber having a feedwater inlet for introducing feedwater into the system, a feedwater discharge chamber having a feedwater outlet for discharging the heated feedwater, a plurality of heating tubes arranged in U form and having their ends connected into said feedwater inlet chamber and feedwater outlet chamber, with feedwater being passed through said tubes, a first cylindrical body housing therein one side portions of the U-formed heating tubes and communicated with said feedwater outlet chamber and also provided with a hot steam inlet for introducing hot steam which serves as feedwater heating source, a second cylindrical body housing therein the other side portions of said U-formed heating tubes and communicated with said feedwater inlet chamber and also provided with a condensate outlet for discharging the steam condensate out of the system, and a spherical container housing therein bent portions of said U-formed heating tubes.

DESCRIPTION OF THE PREFERRED EMBODIMENT

Now, a hairpin type feedwater heater which embodies the principles of this invention is described in detail while referring to the accompanying drawings.

Figure 1:
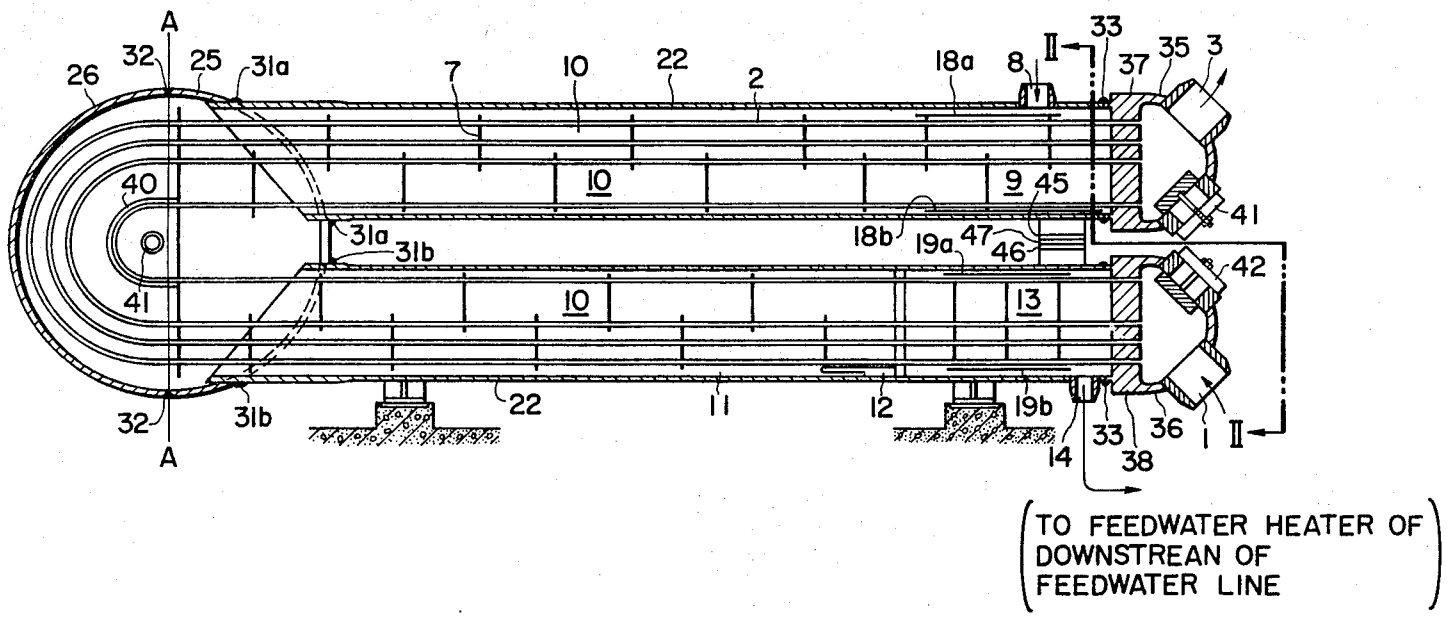
FIG. 1 is a cross-sectional view showing the structural arrangement of a hairpin type feedwater heater embodying the present invention.

Referring to FIG. 1, it will be seen that a pair of cylindrical bodies or shells 21 and 22 are arranged parallel to each other and welded to the hemispherical upper portion 25 of an end cover at 31*a* and 31*b*, respectively. Said upper portion 25 of the spherical end cover is welded to the corresponding hemispherical lower portion 26 of the end cover just at the diametrical joint 32. The other end of the cylindrical body 21 is welded at 33 to a tube plate 37 of a hemispherical feedwater outlet chamber 35 having a feedwater outlet 3. Likewise the other end of the cylindrical body 22 is welded at 33' to a tube plate 38 of a hemispherical feedwater inlet chamber 36 having a feedwater inlet 1. The heating tubes 2 extend out from the tube plate 38 of the feedwater inlet chamber 36 along the interior of the cylindrical body 22 and turn 180° in the spherical end cover 25, 26 to further extend along the interior of the cylindrical body 21 until they reach the tube plate 37 of the feedwater outlet chamber 35. Thus, these heating tubes are arranged in U form. It will be also noted that said heating tubes 2 are secured in position in said cylindrical bodies 21, 22 by means of tube support plates 7. Each of said feedwater outlet and inlet chambers 35 and 36 is provided with a manhole 41, 42 for allowing access into said each chamber for repair of the heating tubes or for other purposes.

The cylindrical body 2l is also provided with a hot steam inlet 8 for introducing high-temperature steam such as bleed from a steam turbine for using such hot steam as heating source for the feedwater heater. Above and below the tube nest of the heating tubes 2 in the cylindrical body 21 and positioned immediately below said hot steam inlet thereof are provided the adjusting plates **18*a* and 18*b* which are joined, as by welding, to the cylindrical body 21. In the section defined by these adjusting plates 18*a* and 18*b* in the cylindrical body 21 is formed a desuper heating zone 9 where the temperature of feedwater flowing in said tubes 2** is raised subtantially equal to or higher than the saturation temperature in the body.

The cylindrical body 22 is provided with a condensate outlet 14 for discharging steam condensate 11 out of the heater unit, and adjusting plates **19*a* and 19*b* are provided above and below the tube nest of the heating tubes 2 positioned close to said condensate outlet in the cylindrical body 2, said adjusting plates being joined, as by welding, to said body 22. Also provided in the cylindrical body 22 is a partition plate 43, and between this partition 43 and the tube plate 38 of the feedwater inlet chamber 36 is defined a drain subcooling zone 13 while producing a pressure difference therebetween so that the steam condensate 11 formed in the condensing zone 10 is sucked into the drain subcooling zone 13 by passing a condensate suction cylinder 12. Said adjusting plates 18*a*, 18*b* and 19*a*, 19*b* function to inhibit the steam flow from escaping to the outside of the respective tube nests so that the steam will flow along the respective tube nests consisting of the heating tubes 2**. Thus, these plates may be flat in shape or may be slightly bent in conformity to the shape of the respective cylindrical bodies.

Figure 2:
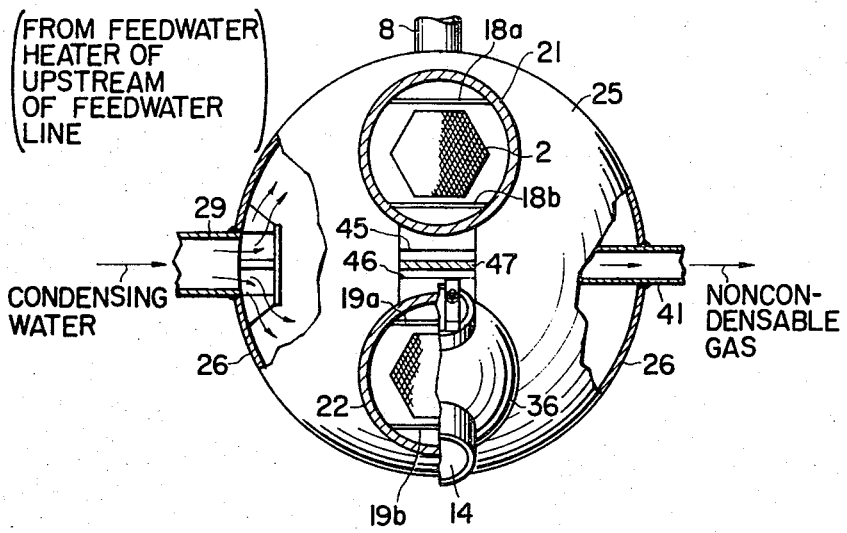
FIG. 2 is a sectional view of the feedwater heater shown in FIG. 1, such view being taken along the line II—II of FIG. 2.

The condensing zone 10 is formed extending through an inside part of the cylindrical body 21, interior of the spherical end cover 25, 26 and an inside part of the cylindrical body 22, that is, said condensing zone extends between the desuper heating zone 9 and the drain subcooling zone 13, and in this condensing zone, the latent heat developed when the saturated steam is condensed to form the condensate 11 is given to the feedwater flowing in the heating tubes 2. A difference in thermal expansion could be produced between the cylindrical bodies 21 and 22 as the steam temperature and the condensate temperature in said both cylindrical bodies 21 and 22 differ considerably from each other. In order to absorb such thermal expansion difference, slide support blocks 45, 46 are provided to said respective cylindrical bodies 21, 22 and a slide plate 47 is disposed between these support blocks so as to be freely slidable therebetween as shown in FIG. 2.

Figure 3:
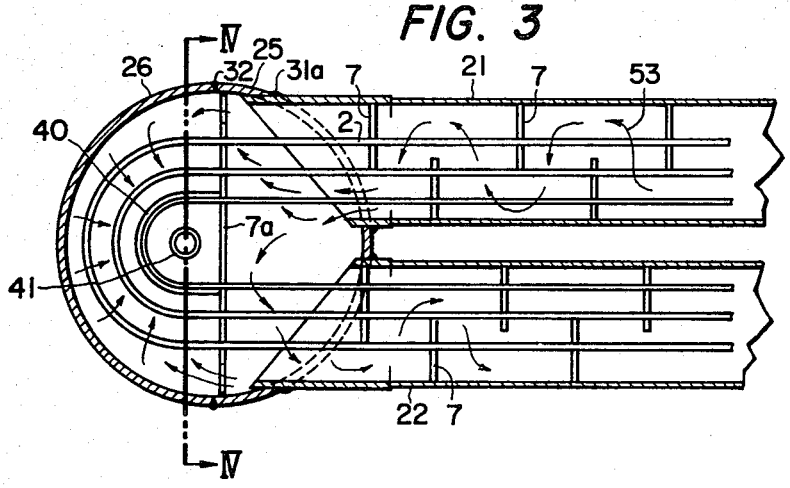
FIG. 3 is a partial sectional view showing the direction of the steam flow in the feedwater heater of FIG. 1.
Figure 4:
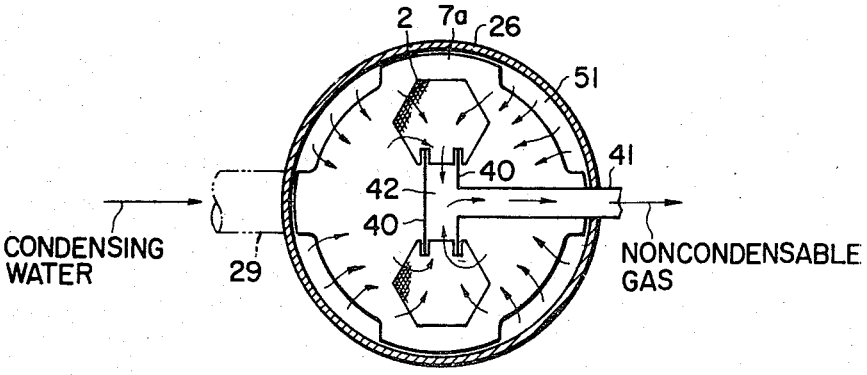
FIG. 4 is a sectional view taken along the line IV—IV of FIG. 3.

In this type of feedwater heater, the non-condensing gas contained in the hot steam might be gradually accumulated in the cylindrical bodies to lower the heat transfer performance of the heater, so that it needs to drive such non-condensing gas out of the heater system. For this purpose, as shown in FIGS. 3 and 4, shield plates 40 are provided to the inner side of the bent portion of the U-shaped heating tube 2 disposed centrally in the spherical end cover 25, 26, and a non-condensing gas collecting chamber 42 is defined between said shield plates 40 and the nest of the heating tubes 2, with a pipe 41 being connected into said collecting chamber 42 for discharging the collected non-condensing gas outside of the heater. In order to incite the non-condensing gas in the heating tube nest in the spherical end cover 25, 26 to flow into said collecting chamber 42, openings 51 are provided in a tube support plate **7*a* provided adjacent to the spherical end cover portion 26 so that said openings 51 serve as passages of steam along the external peripheral surface of said support plate, thereby using a part of the hot steam staying around the tube nests in both cylindrical bodies 21, 22 to flow in from said openings toward the tube nests. Said spherical end cover portion 26 is also provided with a condensate inlet 29 for introducing as heat source the condensate from another feedwater heater portion positioned upstream of feedwater and the introduced condensate is perfectly separated into steam and drain in the spherical end cover assembly 25, 26, thus eliminating the possibility that the drain contained in the condensate should drop into the heating tubes 2** to lower the heat transfer efficiency when said condensate is guided directly into the cylindrical bodies as in the heaters of the prior art. Also, the interior of the spherical end cover may be utilized as a space for conducting treatment of the condensate by reevaporating the condensate flowing thereinto.

The feedwater heater of this invention having the above-described structural arrangement operates as follows.

Referring to FIG. 1 through FIG. 4, feedwater not yet heated flows into the feedwater inlet chamber 36 from the inlet 1 and then is passed through the heating tubes 2 to flow into the feedwater outlet chamber 35 whence it is discharged out from the outlet 3. As said feedwater passes through the drain subcooling zone 13, condensing zone 10 and desuper heating zone 9 successively while flowing in the heating tubes 2, it is heated by steam which also flows in said respective zones 9, 10 and 13. The hot steam serving as heating source is first supplied from the inlet 8 into the desuper heating zone 9 where the temperature of feedwater flowing in the heating tubes 2 is raised to a level substantially equal to the saturation temperature of the steam in the cylindrical body 21. Then said steam flows on along the heating tubes to enter the condensing zone 10 formed in the cylindrical body 21, spherical end cover 25, 26 and another cylindrical body 22, with the flowing direction of said steam being changed frequently as shown by arrows 53 by dint of the tube support plates 7. In this condensing zone 10, steam is condensed into condensate 11, but at this time, latent heat developed when the saturated steam is condensed is given to the feedwater in the heating tubes 2 to thereby heat said feedwater. The steam condensate 11 is then guided into the drain subcooling zone 13 in the cylindrical body 22 from a condensate suction cylinder 12 disposed below the partition plate 43. The interior of said drain subcooling zone 13 is maintained at a lower pressure than the condensing zone 10, and there heat of the condensate is given to feedwater in the heating tubes 2 while preventing reevaporation of the condensate 11. Thereafter, the condensate 11 is discharged out from the outlet 14 and guided back as heat source to the condensate inlet 29 of the feedwater heater located downstream of the feedwater system.

Even if non-condensing gas should be produced in the heating tube nests in the cylindrical bodies 21, 22, such gas is immediately guided into the gas collecting chamber 42 and released to the outside of the system through a conduit 41, so that there is no risk of inviting reduction of the heat exchanging performance by accumulation of the non-condensing gas. It is to be also noted that the steam outside the tube nests is guided through the openings 51 in the tube support plate 7*a* toward the center of the spherical end cover 25, 26, thus encouraging flow of the non-condensing gas into the collection chamber 42. The condensate from the feedwater heater positioned upstream of the feedwater system is guided into said spherical end cover 25, 26 from the condensate inlet 29. Therefore, even though the condensate is separated into steam and drain when the condensate is introduced, said drain is inhibited from dropping into the heating tubes 2 because the spherical end cover is sufficiently large in volume and also because it is sufficiently spaced apart from the heating tube nests. This results in much improvement of the heat exchanging performance.

In this feedwater heater, the heater body is divided into two portions so that it is possible to realize size reduction of the heater body itself. It is also possible to reduce the size of the water chambers as they are constructed from the independent feedwater inlet chamber 36 and feedwater outlet chamber 35. This also allows thinning of the tube plates 37, 38 of the respective water chambers and facilitates machining of the heating tube inserting holes.

The adjusting plates 18*a,* 18*b* defining the desuper heating zone 9 and those 19*a,* 19*b* defining the drain subcooling zones 13 are provided one each above and below each tube nest and they needn't shround the tube nest, so that they are simple in construction and can be easily set in place in the respective cylindrical bodies.

In case the said feedwater heater is adapted in specific applications such as in a nuclear power plant where moisture-rich steam is used as heating source and hence the condensate is produced more than about double that produced in the ordinary steam power plants, it is recommendable to expand the drain subcooling zone 13 along the entire length of the cylindrical body 22 while retrenching the condensing zone 10 to a limited part in the cylindrical body 21. This arrangement makes it possible to guide the condensate formed in the condensing zone 10 in the cylindrical body 21 into the spherical end cover 25, 26 and to make adjustment of the condensate level therein. Also, since said spherical end cover 25, 26 is designed to allow perfect separation of the condensing zone 10 in the cylindrical body 21 from the drain subcooling zone 13 in the cylindrical body 22, there can be eliminated any possibility that the condensate produced in the condensing zone 10 should drop into the heating tubes 2 in the drain subcooling zone 13 to lower the heat transfer performance.

In the feedwater heater of this invention, the spherical end cover is formed from two hemispherical sheel portions 25, 26 welded together along the diametral line A—A, so that when it is desired to make repair or inspection of the heating tubes 2 in the respective cylindrical bodies, it is merely required to demount one side portion 26 of the spherical end cover by heating and breaking the welded joint 32. Thus, it will be noted that the spherical configuration of the end cover and formation thereof from two separably welded portions are intended to allow easy repair and inspection for the heating tubes 2. For repair and inspection of the tube plates 37, 38 in the respective water chambers, the manholes 41, 42 may be opened.

As apparent from the foregoing description, there is provided according to the present invention a hairpin type feedwater heater which has a large capacity with reduced overall structural dimensions and which allows inspection and repair of the internal mechanism with ease.

While a preferred embodiment of the present invention has been shown in detail for purposes of illustration and for the advantages of the specific details, further embodiments, modifications and variations are contemplated according to the broader aspects of the present invention, all is determined by the spirit and scope of the following claims.

What we claim:

1. A feedwater heater comprising:

a plurality of heating tubes arranged in U form for passage of feedwater therethrough;

a feedwater inlet chamber having a feedwater inlet for introducing feedwater thereinto and a tube plate being formed with the inlet chamber in one united body securing one of the ends of said heating tubes collectively in position and also having formed therein a feedwater reservoir;

a feedwater outlet chamber having a feedwater outlet for discharging the heated feedwater and a tube plate being formed with the outlet chamber in one united body securing the other ends of said heating tubes collectively in position and also having formed therein a feedwater reservoir;

a first cylindrical body housing therein the nest of one-side portions of said U-formed heating tubes and having support plates for holding said heating tubes in place, said cylindrical body having its one end connected into said feedwater outlet chamber and also provided with a hot steam inlet for introducing hot steam which acts as a feedwater heating source;

a second cylindrical body housing therein the nest of the other side portions of said U-formed heating tubes and having support plates for holding said heating tubes in place, said second cylindrical body having its one end connected into said feedwater inlet chamber and also provided with a condensate outlet for discharging steam condensate to the outside of the system;

a spherical container having formed therein a space for housing the bent portions of said U-formed heating tubes, said spherical container being constituted from two hemispherical shells, one of which is joined to said both cylindrical bodies:

said spherical container being provided with a condensate inlet means for introducing thereinto as additional heat source the condensate from another feedwater heater unit located upstream of the feedwater system.

2. A feedwater heater comprising:

a plurality of generally horizontal heating tubes arranged in U form for passage of feedwater therethrough;

a feedwater inlet chamber having a feedwater inlet for introducing feedwater thereinto and a tube plate being formed as one integral piece with the inlet chamber in one united body securing one of the ends of said heating tubes collectively in position and also having formed therein a feedwater reservoir;

a feedwater outlet chamber structurally independent of and spaced from said inlet chamber and having a feedwater outlet for discharging the heated feedwater and a tube plate being formed as one integral piece with the outlet chamber in one united body securing the other ends of said heating tubes collectively in position and also having formed therein a feedwater reservoir;

a first horizontal axis cylindrical body housing therein the nest of one-side portions of said U-formed heating tubes and having support plates for holding said heating tubes in place, said cylindrical body extending horizontally and having its one end connected into said feedwater outlet chamber and also provided with a hot steam inlet for introducing hot steam which acts as a feedwater heating source;

a second horizontal axis cylindrical body parallel to said first body and housing therein the nest of the other side portions of said U-formed heating tubes and having support plates for holding said heating tubes in place, said second cylindrical body extending horizontally and having its one end connected into said feedwater inlet chamber and also provided with a condensate outlet for discharging steam condensate to the outside of the system;

a spherical container having formed therein a space for housing the bent portions of said U-formed heating tubes, said spherical container being constituted from two hemispherical shell elements;

a first one of said hemispherical shell elements being connected to the end of each of said cylindrical bodies opposite from said inlet and outlet chambers to hold said cylindrical bodies in spaced side by side relationship, and having its circular periphery in a generally vertical plane;

the second one of said hemispherical shell elements being unconnected to said cylindrical bodies and said tubes, and having its circular periphery connected to the periphery of said first hemispherical shell so as to be removable for repair and replacement access to said tube bent portions;

means having plate members disposed one above the heating tube nest positioned within said first cylindrical body on the hot steam inlet side and the other below said tube nest so that said plate members are connected to the first cylindrical body and extend along a length of said tube nest, and forming a desuper heating zone to give heat of said hot steam to feedwater in said heating tubes in a part of said first cylindrical body within the range of said plate members.

means having similar plate members also disposed one below the heating tube nest positioned within said second cylindrical body on the condensate outlet side and the other above said tube nest so that said similar plate members are connected to the second cylindrical body and extend along a length of said tube nest, and forming a drain subcooling zone to give heat of the condensate to feedwater in said heating tubes in a part of said second cylindrical body within the range of said plate members; and means having a condensing zone to give latent heat developed at the time of condensation of steam to feedwater in said heating tubes in the part of the first cylindrical body not including said desuper heating zone, the part of the second cylindrical body not including said drain subcooling zone and said spherical container.

3. A feedwater heater as described in claim 2, further including:

each of said inlet and outlet chamber being provided with a manhole formed therein and further being of a hemispherical shape; and a gas collecting chamber means provided in said spherical container for collecting non-condensing gas existing in said both cylindrical bodies as well as in said spherical container, said chamber being provided with a pipe for bleeding said gas to the outside of the heater system.

4. A feedwater heater as described in claim 3, including a support plate provided in said spherical container formed at its peripheral edge with openings for urging steam existing around the tube nest in each said cylindrical bodies to flow into said spherical container.

5. A feedwater heater as claimed in claim 3, wherein support blocks are provided on the opposing external surfaces of said first and second cylindrical bodies, and a slide member is also provided between said both support blocks so that said slide plate is freely slidable therebetween.

6. A feedwater heater as described in claim 3, wherein:

said similar plate members are disposed within and along the entire length of said second cylindrical body for forming the drain sub-cooling zone.

* * * * *